US005637819A

United States Patent [19]

Rogers

[11] Patent Number: 5,637,819

[45] Date of Patent: Jun. 10, 1997

[54] PERCUSSION INSTRUMENT DAMPING

[75] Inventor: Thomas P. Rogers, Englewood, N.J.

[73] Assignee: Rtom Corporation, Englewood, N.J.

[21] Appl. No.: 902,715

[22] Filed: Jun. 23, 1992

[51] Int. Cl.[6] ..... G10D 13/02

[52] U.S. Cl. ..... 84/411 M; 181/167

[58] Field of Search ..... 84/411 M, 453; 181/167, 169

[56] References Cited

U.S. PATENT DOCUMENTS

| | | | |
|---|---|---|---|
| 4,076,098 | 2/1978 | Ward | 181/169 X |
| 4,154,137 | 5/1979 | Kobayashi | 84/411 R |
| 4,226,156 | 10/1980 | Hyakutake | 84/411 M X |
| 4,581,973 | 4/1986 | Hoshino | 84/411 P X |
| 4,649,793 | 3/1987 | Blackshear et al. | 84/453 |
| 4,745,839 | 5/1988 | Peraino | 84/411 M |
| 4,776,254 | 10/1988 | Cruz | 84/422 R |
| 5,370,991 | 12/1994 | Remold-O'Donnell | 435/6 |
| 5,375,889 | 12/1994 | Nakashiba et al. | 285/21 |

*Primary Examiner*—Cassandra C. Spyrou
*Attorney, Agent, or Firm*—Fish & Richardson P.C.

[57] ABSTRACT

A damped percussion instrument has a vibratable surface. A damping gel patch is attached to the surface.

20 Claims, 5 Drawing Sheets

PERCUSSION INSTRUMENT DAMPING

This invention relates to damping a percussion instrument surface.

According to the invention, a gel patch, typically self-adhesive, adheres to a vibratable percussion instrument surface externally of the surface and dampens the surface.

Other features, objects, and advantages of the invention will become apparent from the following description when read in connection with the accompanying drawings in which.

Figure 11:
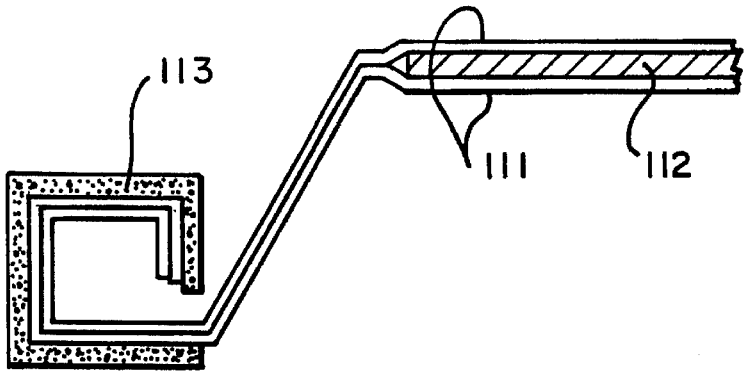

FIG. 11 a perspective view of a damped electronic drum.

Figure 12:
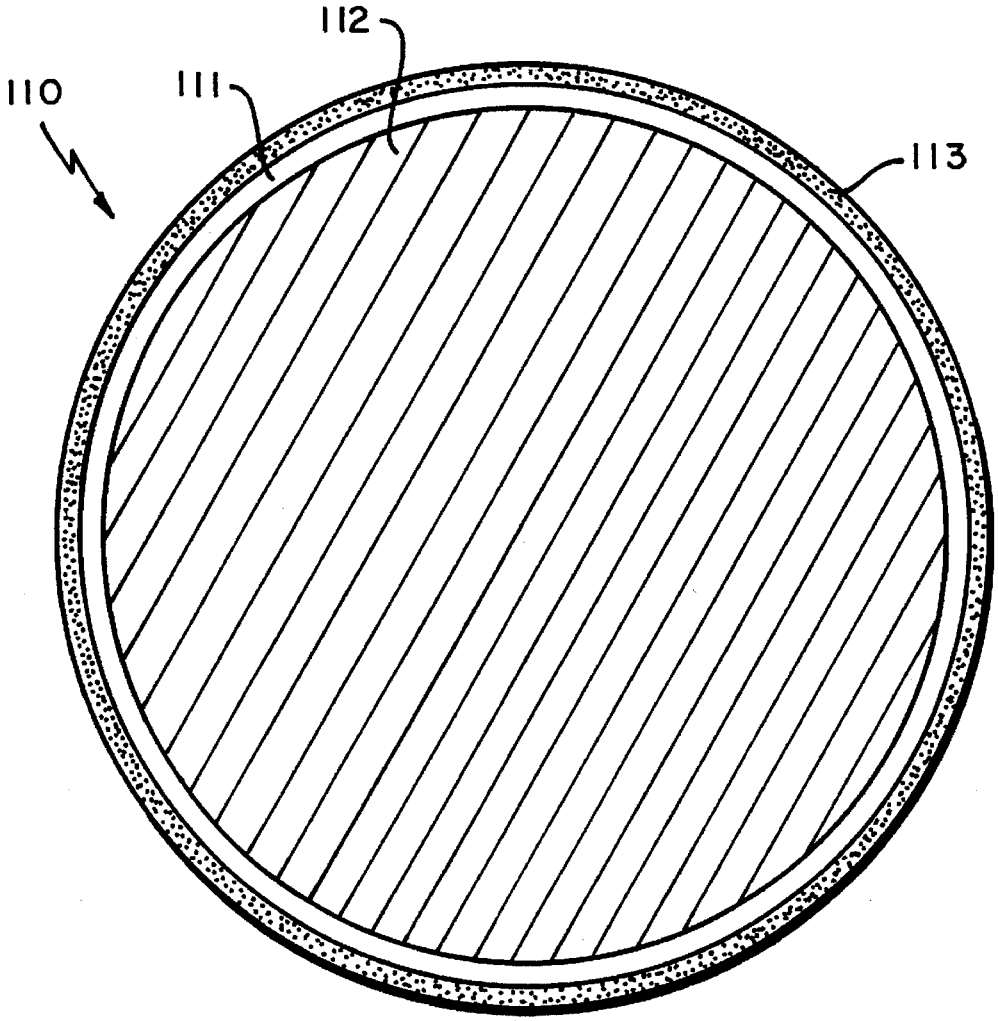

FIG. 12 is a cross-sectional view of a damped electronic drum.

Figure 1:
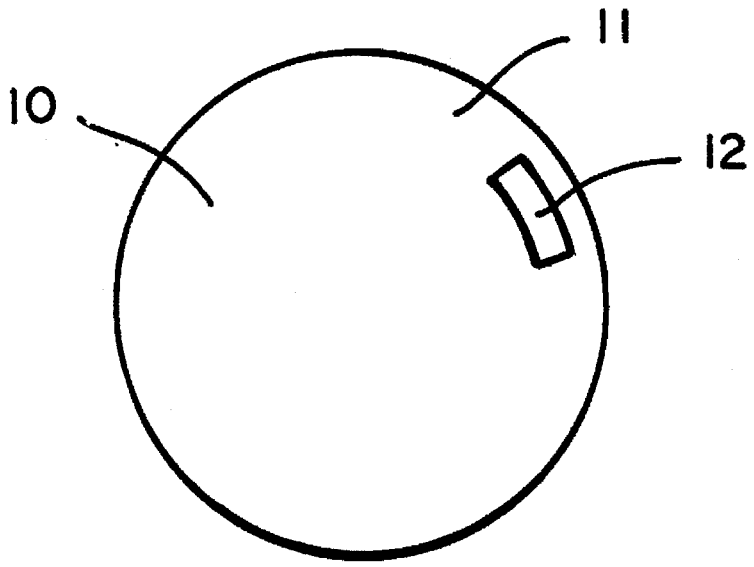
FIG. 1 is a pictorial view of a damped cymbal according to the invention.

Referring to FIG. 1, a cymbal 10 has a surface 11 carrying a gel patch 12. In the embodiment shown, the gel patch 12 is dimensioned one and one-half inches (length) by one inch (width) by one eighth of an inch (depth).

Figure 2:
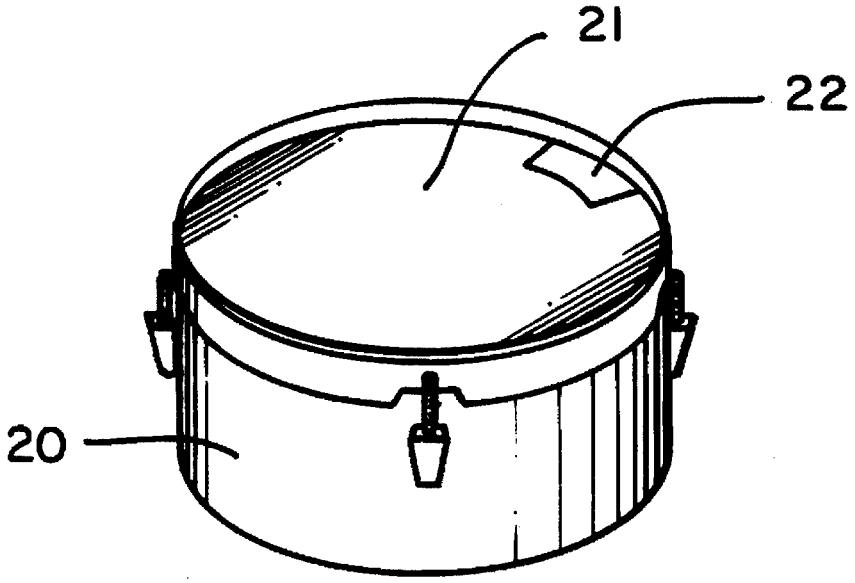
FIG. 2 is a pictorial view of a damped snare drum according to the invention.

Referring to FIG. 2 a snare drum 20, has a head surface 21 carrying a gel patch 22. In the embodiment shown, the gel patch is dimensioned two inches (length) by one inch (width) by one eighth inch (depth).

Figure 3:
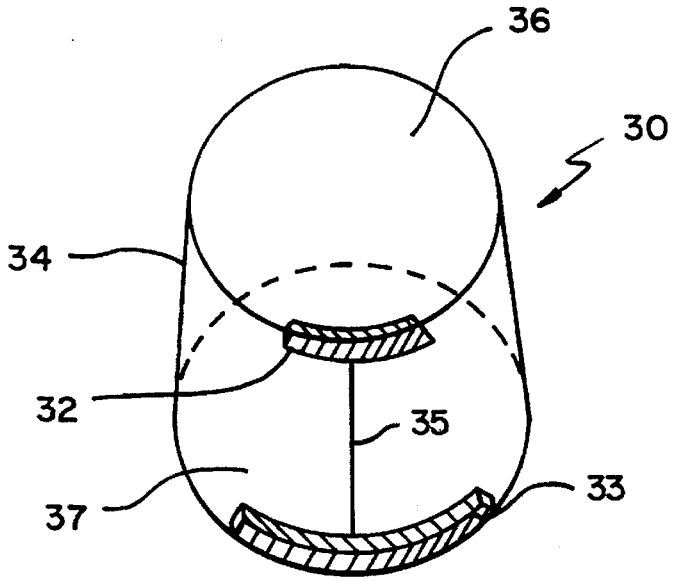
FIG. 3 is a pictorial view of a damped bass drum according to the invention.
Figure 4:
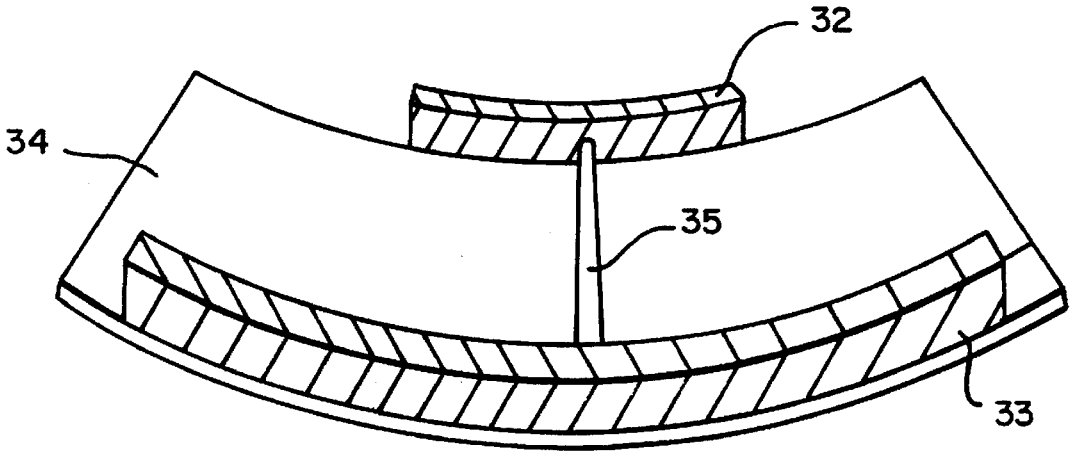
FIG. 4 is a cross-sectional view of a damped bass drum.

Referring to FIG. 3, a bass drum 30 has a front drum head 36 and a batter side drum head 37 and carries two gel patches 32, 33. A patch 32 is on the interior surface 31 of the batter side drum head along the edge abutting the drum shell 34, and the other patch is on the interior of front side drum head 36 along the edge abutting the drum shell. The two patches are at directly opposite edges of the drum shell and are connected therebetween by a support rod 35. In the embodiment shown, the batter side gel patch 33 is dimensioned sixteen inches (length) by six inches (width) by two inches (depth) and the front side gel patch 32 is dimensioned six inches (length) by three inches (width) by two inches (depth). The same reference numerals are used in the cross-sectional view of a damped bass drum in FIG. 4.

Figure 5:
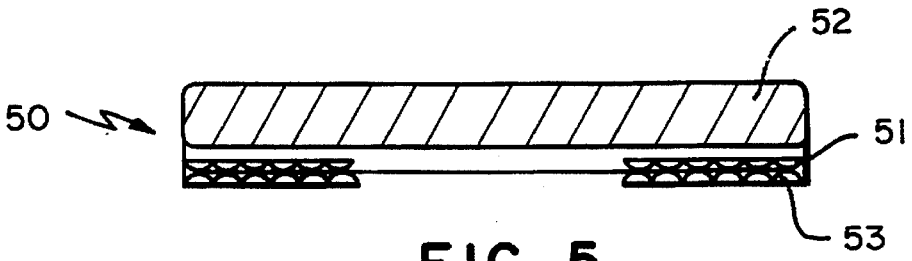
FIG. 5 is a cross-sectional view of a damped work out pad.

Referring to FIG. 5, a workout pad 50 has a plexiglass sheet 51 which carries a gel patch 52. In the embodiment shown the gel patch is dimensioned four inches (length) by four inches (width) by one-half inch (depth). The sheet 51 sits on suction cup feet 53.

Figure 6:
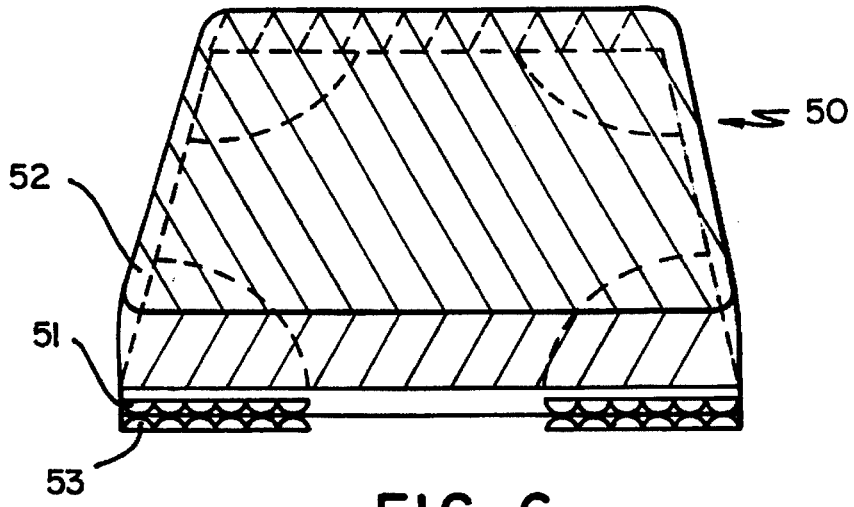
FIG. 6 is a perspective view of a damped work out pad.
Figure 7:
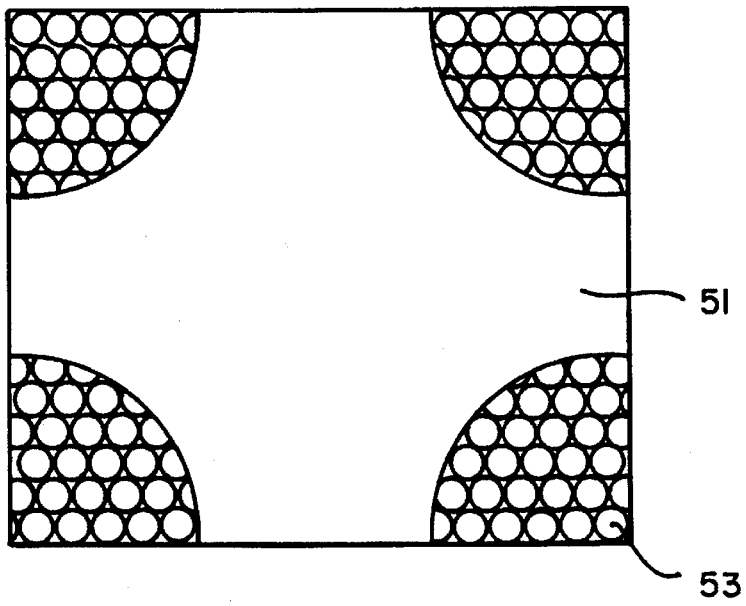
FIG. 7 is a view of the bottom of a damped work out pad.

The same reference numerals are used in the perspective and bottom views of a damped workout pad in FIGS. 6 and 7.

Figure 8:
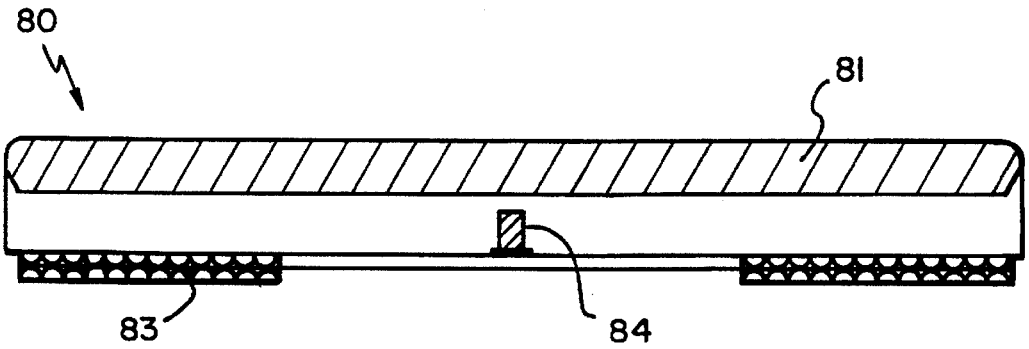
FIG. 8 is a cross-sectional view of a damped work out pad.

Referring to FIG. 8 a workout pad 80 has a tray 82 carrying a gel patch 81. Tray 82 sits on a ring-shaped footing of suction cups 83. Screw mount 84 is attached to the center of tray 82.

Figure 9:
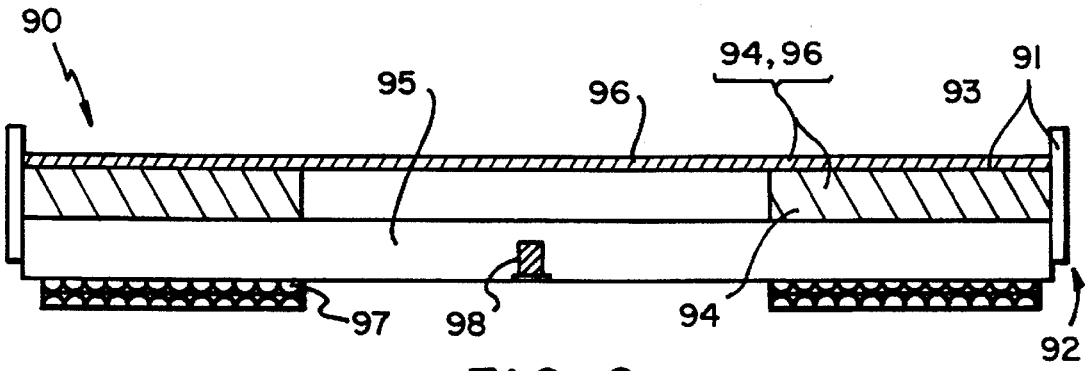
FIG. 9 is a cross-sectional view of a damped practice pad.
Figure 10:
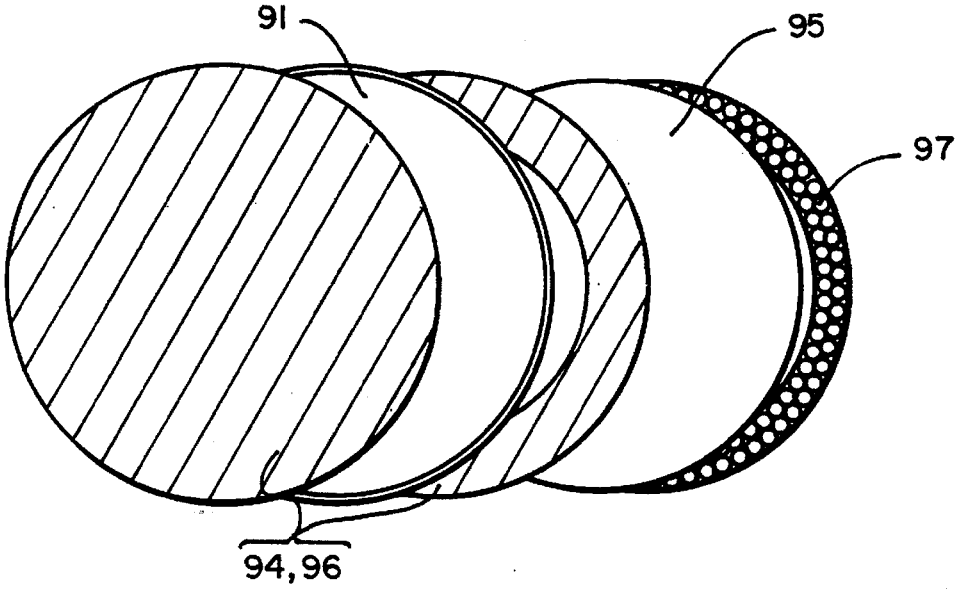
FIG. 10 is an expanded apart view of a damped practice pad.

Referring to FIG. 9 a practice pad 90 has a drum head 91. The drum head side member 92 surrounds the drum head surface 93. Under the surface 93 is a ring-shaped gel patch 94 sitting on a plastic tray 95. Above surface 93 sits a circular neoprene patch 96. In the embodiment shown the patches 94, 96 abut drum head side member 92. Plastic tray 95 sits on a ring-shaped footing of suction cups 97. Screw mount 98 is attached to the center of plastic tray 95. The same reference numerals are used in the exploded view of a damped practice pad in FIG. 10.

Referring to FIG. 12, the head 111 of a damped electronic drum 110 holds a gel patch 112. A rim 113 surrounds the drum head 111. The same reference numerals are used in the cross-sectional view of a damped electronic drum in FIG. 11.

In the exemplary embodiment the gel comprises 53% PVC copolymer resin, 27% Dioctyl Terephthalate, 2.5% Epoxied Soybean Oil, 3% Calcium-Zinc Stabilizers, 7% PVC-based Thixotrope and 7.5% Adipate Plasticizer-based Thixotrope. Gel of this composition is commercially available from WRS SportsMed, a division of WRS Group, Inc. under the UltraSoft™ trademark.

The invention has a number of advantages. Depending on the quantity of gel applied the vibration may be partially or completely damped. The gel is composed to adhere to the surface even if the surface is struck hard by the player of the percussion instrument.

Other embodiments are within the claims.

What is claimed is:

1. A damped device comprising:

a vibratable surface, and a damping gel patch external of and attached to said vibratable surface.

2. A damped device in accordance with claim 1 wherein said gel patch has a depth of no more than one eighth inch, a length of no more than three inches, and a width of no more than one inch.

3. A damped device in accordance with claim 1 wherein said patch is ring-shaped.

4. A method of damping a vibratable surface of a device comprising, applying a gel patch to and externally of the vibratable surface.

5. Apparatus for damping the vibratable surface of a device comprising, a gel patch constructed and arranged to be attached to and externally of said vibratable surface.

6. Apparatus in accordance with claim 5 wherein said gel is substantially comprised of PVC copolymer resin.

a gel patch constructed and arranged to be attached to and externally of said vibratable surface.

7. A damped device comprising:

a vibratable surface, and a damping gel patch attached to said vibratable surface, wherein said vibratable surface comprises a percussion instrument.

8. A damped device in accordance with claim 7 wherein said vibratable surface comprises a cymbal.

9. A damped device in accordance with claim 7 wherein said vibratable surface comprises a drum.

10. A damped device in accordance with claim 8 wherein said gel patch is substantially one and one-half inches long, substantially one inch wide, and substantially one-eighth inch deep.

11. A damped device in accordance with claim 9 wherein said gel patch is substantially two inches long, substantially one inch wide, and substantially one-eighth inch deep.

12. A damped device in accordance with claim 9 and further comprising a second vibratable surface comprising said drum, a drum shell separating said vibratable surfaces, a second gel patch attached to said second vibratable surface.

13. A damped device in accordance with claim 12 wherein said gel patches are attached to said vibratable surfaces adjacent to said drum shell.

14. A damped device in accordance with claim 13 and further comprising a support rod interconnecting said gel patches.

15. A damped device in accordance with claim 13 wherein the first-mentioned gel patch is substantially six inches long, substantially three inches wide, and substantially two inches deep, and said second gel patch is substantially sixteen inches long, substantially six inches wide, and substantially two inches deep.

16. A damped device in accordance with claim 14 wherein the first-mentioned gel patch is substantially six inches long, substantially three inches wide, and substantially two inches deep, and said second gel patch is substantially sixteen inches long, substantially six inches wide, and substantially two inches deep.

17. A damped device comprising:

a vibratable surface, and a damping gel patch attached to said vibratable surface, wherein said vibratable surface comprises a workout pad comprising a sheet carrying said gel patch.

18. A damped device in accordance with claim 17 wherein said sheet is plexiglass and said gel patch is substantially four inches long, substantially four inches wide, and substantially one-half inch deep.

19. A damped device in accordance with claim 18 and further comprising suction cup feet attached to said sheet.

20. A damped device comprising:

a vibratable surface, and a damping gel patch attached to said vibratable surface, wherein said vibratable surface comprises a practice pad with a drum head.

* * * * *